US005664905A

United States Patent [19]

Thompson et al.

[11] Patent Number: 5,664,905

[45] Date of Patent: Sep. 9, 1997

[54] FENCE

[75] Inventors: Peter John Thompson, Surrey; Iain James McGregor, Derby, both of United Kingdom

[73] Assignee: Alcan Aluminium UK Limited, Buckinhgamshire, England

[21] Appl. No.: 382,014

[22] PCT Filed: Aug. 4, 1993

[86] PCT No.: PCT/GB93/01649

§ 371 Date: Apr. 28, 1995

§ 102(e) Date: Apr. 28, 1995

[87] PCT Pub. No.: WO94/03678

PCT Pub. Date: Feb. 17, 1994

[30] Foreign Application Priority Data

Aug. 10, 1992 [GB] United Kingdom ..... 9216936
Mar. 15, 1993 [GB] United Kingdom ..... 9305267

[51] Int. Cl.[6] ..... E01F 15/00

[52] U.S. Cl. ..... 404/6; 256/13.1; 248/548; 248/900

[58] Field of Search ..... 404/6, 7, 9, 10, 404/11; 256/1, 13.1, 19; 403/2; 52/98; 248/548, 900

[56] References Cited

U.S. PATENT DOCUMENTS

| | | | |
|---|---|---|---|
| 3,258,250 | 6/1966 | McMullin | 256/13.1 |
| 3,388,892 | 6/1968 | Case | 256/13.1 |
| 3,499,630 | 3/1970 | Dashio | 256/13.1 |
| 3,567,184 | 3/1971 | Yancey | 256/13.1 X |
| 4,289,301 | 9/1981 | Akabame et al. | 256/13.1 |
| 4,330,106 | 5/1982 | Chisholm | 256/13.1 X |
| 4,432,172 | 2/1984 | Kuykendall et al. | 404/10 X |
| 4,610,432 | 9/1986 | Lewis et al. . | |
| 5,160,111 | 11/1992 | Hugron | 248/548 |
| 5,214,886 | 6/1993 | Hugron | 52/98 |

FOREIGN PATENT DOCUMENTS

| | | |
|---|---|---|
| 0005065 | 10/1979 | European Pat. Off. . |
| 1810210 | 10/1969 | Germany . |
| 485914 | 3/1970 | Switzerland . |
| 1103370 | 2/1968 | United Kingdom . |
| 1209191 | 10/1970 | United Kingdom . |
| 1452063 | 10/1976 | United Kingdom . |
| 2032496 | 5/1980 | United Kingdom . |

*Primary Examiner*—Michael Powell Buiz
*Assistant Examiner*—James A. Lisehora
*Attorney, Agent, or Firm*—Watts Hoffmann Fisher & Heinke

[57] ABSTRACT

A crash barrier including a post secured to a base at its lower end, the post having a front face to which one or more rails are secured, the post also having two side faces and a rear face. The rear face of the post is formed with a horizontally extending notch having upper and lower surfaces. When an impact load is transmitted to the front face of the post, the post is caused to distort in a region including the notch so that the upper and lower surfaces of the notch close towards one another prior to any fracture at or adjacent the front face of the post or at or adjacent its lower end.

28 Claims, 7 Drawing Sheets

FENCE

BACKGROUND OF THE INVENTION

1. Field of the Invention

This invention relates to fences and more particularly to crash barriers for location alongside a vehicle carrying bridge or road.

2. Description of the Related Art

Many proposals have been made and crash barriers are in extensive use in many countries. GB patent 1209191 shows a construction in aluminium alloy which has been widely used. In the arrangement of GB 1209191 a series of upright posts are joined by several horizontal rails. The posts are designed to be frangible and to fail upon vehicle impact in order to absorb as much of he impact energy as possible. The failure zone in this case is at or near a welded joint between the post and a base plate and it has not proved possible to predict accurately the impact load that will cause failure. This is because there can be significant differences in the strength characteristics of the welds from post to post and also adjacent to the welds there is a heat affected zone which again may vary the strength characteristics of one post compared with another.

Thus it has been found that the posts of GB 1209191 tend to tear away their base weld upon rotation, upon impact, through about 2° but that the impact load to achieve this varies from post to post by up to 30%.

Applicants are aware of one previous proposal to provide more accurate and reproducible post distortion. This is in a Japanese product (GB 2032496 A) where the rear wall of each post is formed with a shallow inward curve extending from the base of the post to a position nearly halfway of its height. This arrangement undoubtedly ensures that upon impact the post will crumple firstly at the curve. However the vertical extent of the curve and the uncertainty of its large radius of curvature ensures that there will still be variations in distortion of different posts subjected to the same impact load.

In the arrangement of GB 1209191 the rails are formed with a rearwardly facing re-entrant slot to receive the heads of four bolts secured through holes in the flat front faces of the posts. With this arrangement, the restraint to "windmilling" is dependent only upon the four bolts.

Additionally GB 1209191 provides for sheets of wire mesh to be provided as infill between the rails. However different rail sections having extruded slots are used to receive differently sized sheets of mesh. During accident damage repair it is necessary to partly dismantle the rail structure to slide out the mesh and replace it.

Thus it is an object of the present invention to provide an improved crash barrier of posts and rails in which greater control than hitherto is provided for the collapse of the posts under a known impact load.

A further object is to provide an improved method of securing the rails to the posts to reduce the possibility of windmilling.

Another object is to provide improved fixings for infill sheets to enable these to be readily replaced. A further object is to provide an improved base plate for the posts.

SUMMARY OF THE INVENTION

According to one aspect of the present invention there is provided a post for use in a post and rail crash barrier comprising a lower end to be secured to a base, a front face to which one or more rails may be secured a rear face and two side faces characterised in that the rear face or the rear face and at least one of the side faces is formed at a position intermediate its length with a horizontally extending first notch or cut-out having upper and lower surfaces so that, when the lower end is restrained, an impact load transmitted to the front face causes the post to distort firstly in a region including the notch so that the surfaces close towards one another prior to any fracture at or adjacent the front face of the post or at or adjacent its restrained lower end. The distortion may continue until the surfaces close together. Alternatively the distortion may continue until the surfaces close on to an intermediate member. Preferably the impact load required to distort the post after the surfaces have closed together or against an intermediate member is not less than that required to commence closure of the surfaces. One or more additional notches may be provided above the first notch, all the notches being of such size and shape that upon application of the impact load their upper and lower faces close together in vertical succession.

Preferably the post is a hollow extrusion from an aluminium alloy and is generally rectangular in cross-section, with two sidewalls and front and rear faces and having a web extending across the post between the side walls at a position spaced from the front and rear faces. The upper end of the rear face may be tapered upwardly towards the front face.

The or each notch may be -V- shaped (having a base radiussed to a small curvature). Alternatively the or each notch may be parallel sided with a flat base incorporating subsidiary notches.

Means may be provided to encourage the post to distort evenly across its width after being subject to an impact load. In one arrangement a -U- shaped guide embraces the rear face and extends along the side walls of the post in the region of the notch. Another arrangement has a guide disposed in contact with a surface of the notch in the rear face and has parts extending both inside and outside the rear face in spaced relationship to the other surface of the notch in the rear face. Alternatively at least two notches may be separated by at least one web which deforms plastically prior to the surfaces of the notches closing together.

There is also provided a crash barrier comprising a series of posts according to the present invention arranged generally vertically in spaced apart relation the posts being secured to base plates mounted on plinths firmly anchored in the ground, each post being joined by one or more rails extending transversely across the front faces of the posts. The rails may be secured to spacers welded to the front face of each post, the spacers having formations to engage the rails to prevent rotation of the rails relative to the posts. Preferably the spacers extend beyond each side face of the posts and the rails are bolted only to the spacers.

Each rail may have a re-entrant slot formed in its rear face to receive the heads of bolts with the intermediary of an elongated member disposed beneath the bolt heads and bearing against the inner surface of the rear face of the rail with the outer surface of this rear face in close contact with the spacer. Preferably the washer is -U- shaped having a base wall and side walls which closely embrace the bolt heads, the member being approximately the same length as the spacer.

The rails may be formed with front faces having longitudinal upper and lower re-entrant slots to receive nose pieces for carrying a screen of wire mesh or other material. The nose piece in the uppermost rail may be a clip fit therein and extends continuously therealong having a downwardly opening slot to receive the upper edge of the screen material. A multiplicity of bracket-like nose pieces may be disposed in a lower rail to support the lower edges of the screens.

Alternatively the nose piece on each rail is slidable in the slots and comprises a hook to engage with horizontal components of wire mesh screens. A continuous trim may be secured to the hook or hooks of the uppermost rail and has a part to hold the upper end of the screen against the rail.

The post is preferably secured to a base plate of an aluminium alloy extrusion. The base plate my have a flat lower face, side flanges and a central platform raised above the upper faces of the flanges, the side edges of the platform being bounded by upwardly extending longitudinal ribs and shoulders being formed to extend outwardly of the ribs intermediate the levels of the platform and the faces.

BRIEF DESCRIPTION OF THE DRAWINGS

Various aspects of the present invention will now be described by way of example with reference to the accompanying drawings in which.

DESCRIPTION OF THE PREFERRED EMBODIMENTS

Figure 1:
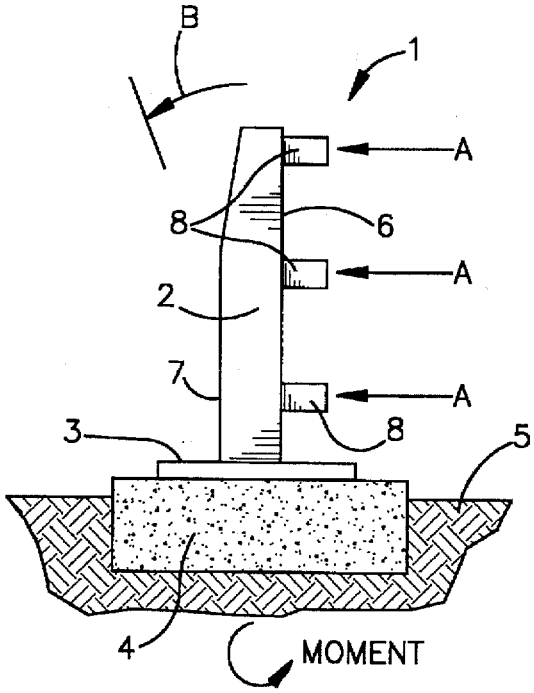
FIG. 1 is a diagrammatic end view of a crash barrier.

Referring to FIG. 1 a crash barrier 1 has a series of spaced apart, vertical posts 2 each mounted on a base plate 3 secured to a concrete plinth 4 set in the ground 5. The posts have front and rear faces 6 and 7 and, typically, three rails 8 extend from post to post secured to their front faces 6. It will be understood that impact loads on the rails in the direction of the arrows -A- cause the post 2 to tend to rotate, say through the angle -B-. Frequently the turning movement causes unpredictable distortion of the post until it tears away from the base 3.

It is desirable to absorb as much of the impact energy as possible before the post is torn from its base so it is not appropriate merely to provide ever stronger posts and ever stronger fixings to the base plate. While some rough calculations have been possible in the past to provide posts that will distort under impact load and absorb some of the impact load energy, consistent results have not been possible.

Figure 2:
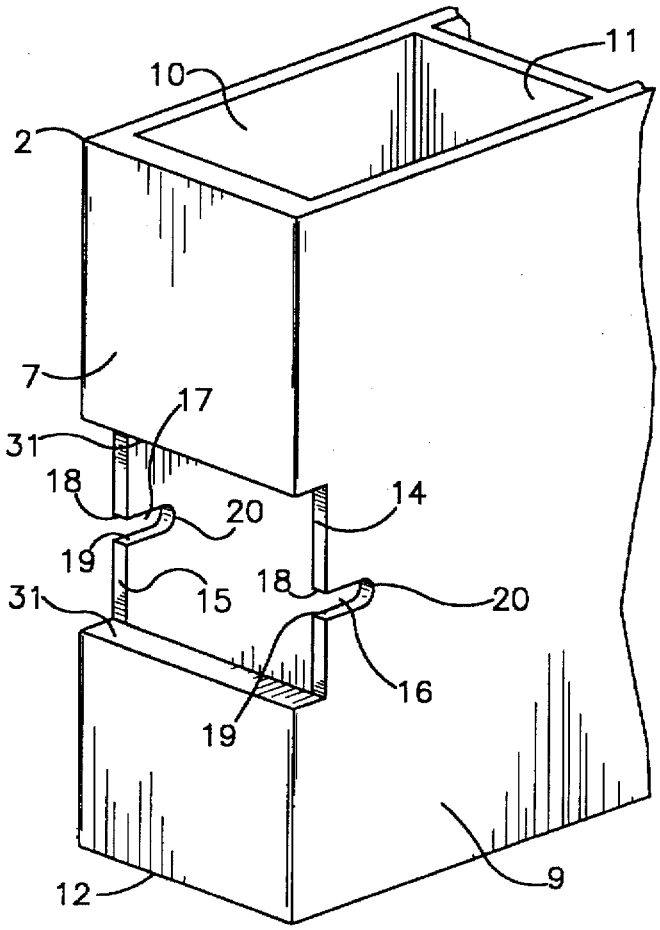
FIG. 2 is a rear perspective view of part of a post showing one form of notch.

FIG. 2 shows a post 2 of the present invention. This is extruded and is of double box section having a rear face 7, side faces 9 and 10 and a web 11 extending between the side faces. At a location spaced above its lower end 12 the rear face 7 is cut away to constitute a rectangular notch 13 having side edges 14 and 15. Subsidiary notches 16 and 17 are cut in the edges 14 and 15 each having parallel upper and lower faces 18 and 19 and semi-circular ends 20.

In use and when subject to an impact load some of the energy thereof is absorbed by the rails and posts by elastic deformation. Thereafter controlled buckling of the post is initiated at the subsidiary notches 16 and 17 while the faces 18 and 19 close together. Thereafter the side walls 9 and 10 continue to buckle in the region of the notch 13 until the upper and lower edges of this notch meet. It will be apparent that this buckling distorts the side walls either inwards or outwards. When the upper and lower edges of the notch have closed together the stiffness of the post increases and further deformation takes place until the front face 6 of the post fractures or the post is torn from its base. During the deformation adjacent the notch 13 the web 11 helps to reduce any tendency for the post 2 to twist.

We have found that the provision of the notch enables distortion of the post to occur under more closely predetermined impact loads than has hitherto proved possible The predetermined impact value depends on the containment level required. A three rail system to retain automobiles may be designed to buckle at 30 Kilo Newton Meters (KNM) moment capacity A two rail system may be designed to buckle at about 15 KNM moment capacity. For lorry containment the figure might be 60 KNM moment capacity or higher. It will be understood that a series of notches could be provided in the rear face of the post. In such case it is preferable that the notches should be so shaped or sized that they distort sequentially either in upward or downward sequence.

We have also found that additional control over the final collapse of a post can be obtained by using an improved base plate and welding the post thereto with the use of welded reinforcement between the post and the plate. In the past base plates have usually been cast from an aluminium alloy. These are relatively expensive and consistent quality control is difficult.

Figure 3:
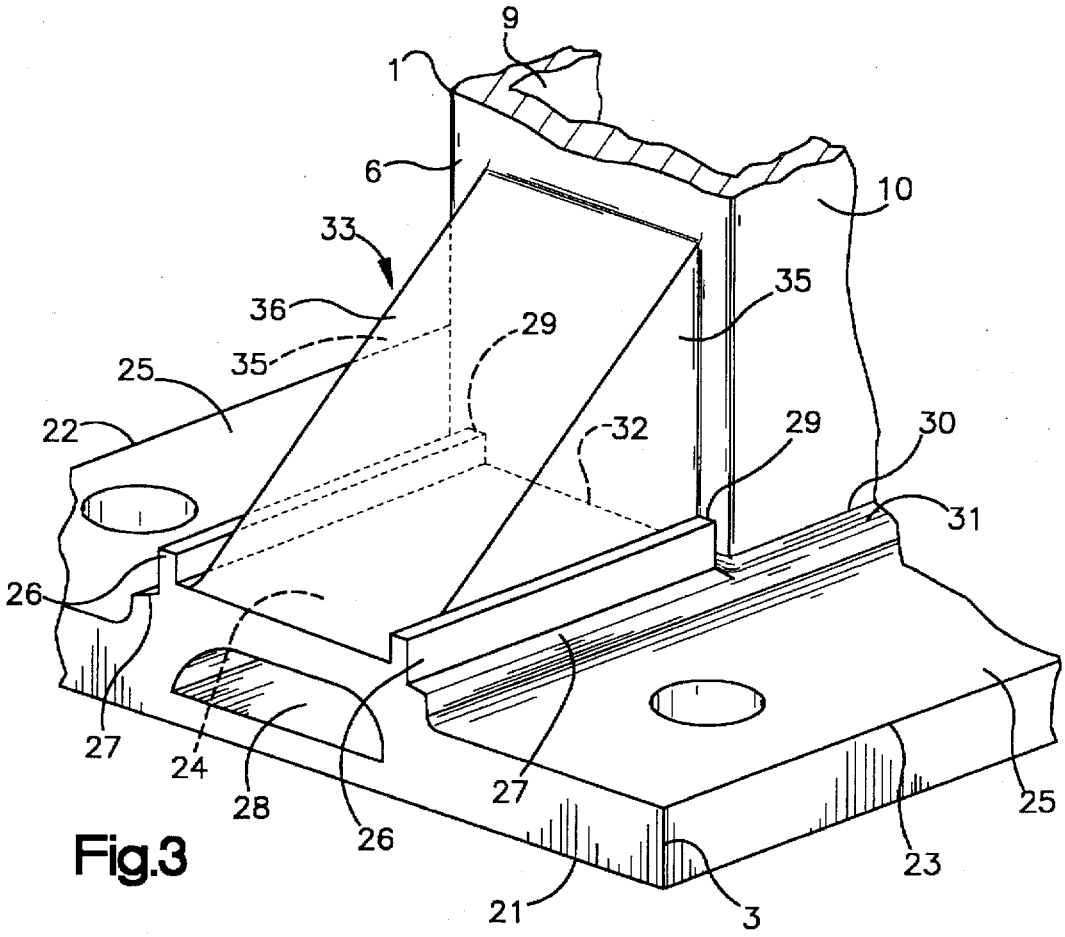
FIG. 3 is a detail in front perspective of the post fixed to a base plate.

FIG. 3 shows a base plate 3 extruded from an aluminium alloy and having a flat lower face 21, side flanges 22 and 23 and a central platform 24 which is raised above the upper faces 25 of the flanges. The platform 24 is bounded by ribs 26 and shoulders 27 extend outwardly of the ribs intermediate the level of the platform 24 and the faces 25. The base is formed with a longitudinal hollow 28 beneath the platform. It will be seen from FIG. 3 that the front face 6 of the post 1 is formed with slots 29 to embrace the ribs 26. Similar slots (not shown) are formed in the rear face 7 (not shown in FIG. 3) of the post. The lower edges of the front and rear faces 6 and 7 thus rest upon the platform 24 but the lower edges, such as 30, of the side walls 9 and 10 are spaced from the shoulders 27 to receive weld material such as 31. The lower edges of the front and rear faces 6 and 7 are welded as at 32 around the ribs 26 and across the platform 24.

Figure 4:
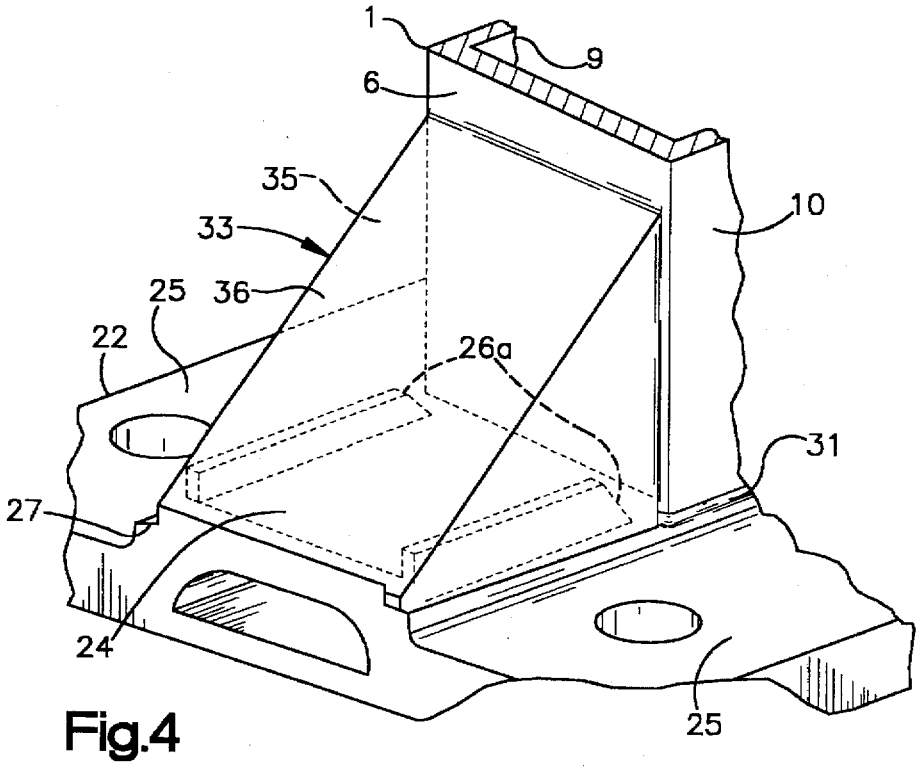
FIG. 4 is a view similar to FIG. 2 of another arrangement of post and base plate.

At the front face only of the post a triangular box reinforcement 33 is welded to the post, the ribs 26 and the platform 24. The box comprises side plates 35 and a top plate 36. FIG. 4 is a view similar to FIG. 3 of a simplified arrangement. In this case the lower end of the front face 6 is not slotted to embrace the ribs 26 but instead these ribs are themselves slotted at **26*a* to receive the lower edge of the front face 6. In addition the box reinforcement 33 embraces the outside of the ribs 26. If the upper ends of the posts 2 are tapered as mentioned above, cut-out pieces may be used for the box 33**.

Figure 5:
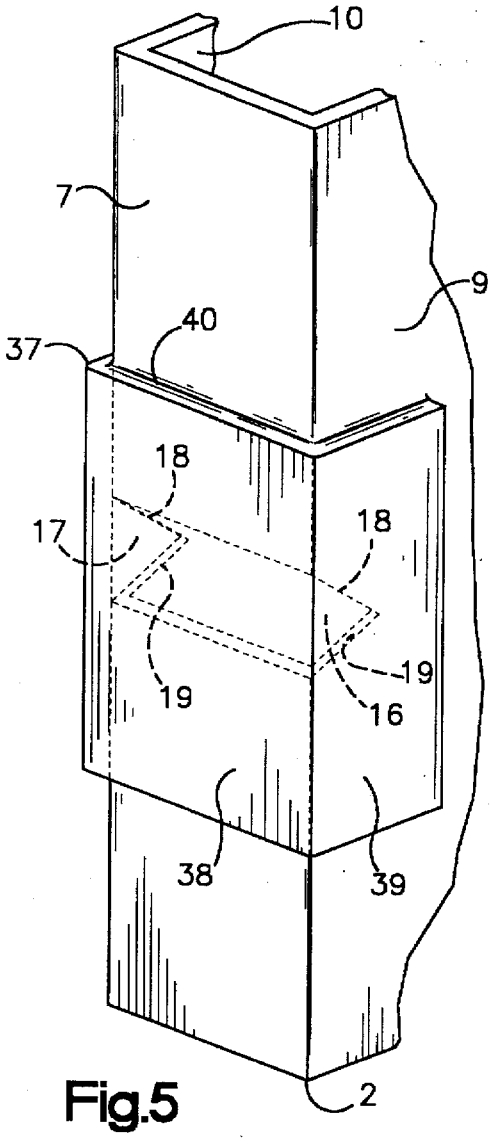
FIG. 5 is a rear perspective view of part of a post showing another form of notch with a -U- shaped guide.

FIG. 5 shows a simpler modification of the arrangement of FIG. 2. Here notches 16 and 17 are -V- shaped. A -V- shaped notch has the advantage that when the post distorts to close the faces of the notch together, these faces lie in contact with one another. Since there may still be a tendency for the post to twist during deformation (in spite of the web 11) a -U- shaped guide 37 having a base 38 and side walls such as 39 is located around the rear of the post in the region of the notch with the side walls embracing the side walls 9 and 10 of the post. The guide is welded to the post only around its upper end as at 40. As the post distorts the side walls 9 and 10 are firmly restrained and any tendency for the post to twist at the notch is reduced.

Figure 6:
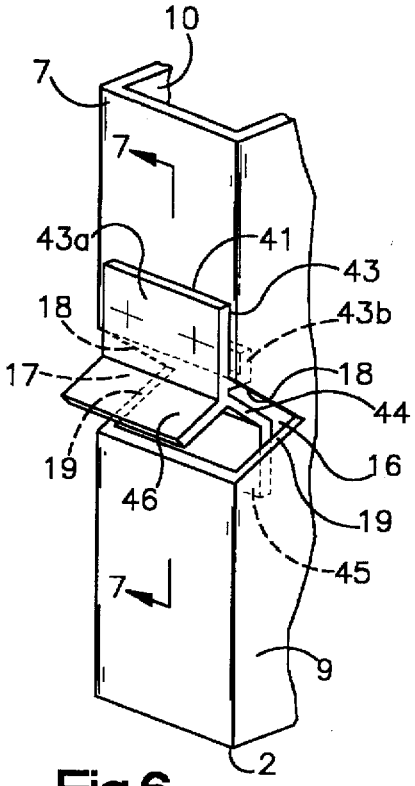
FIG. 6 is a similar view to a smaller scale showing a different guide.
Figure 7:
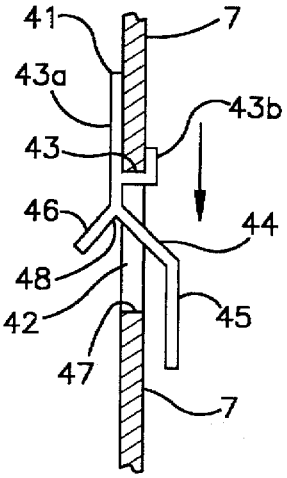
FIG. 7 is a section on the line A—A of FIG. 6.

FIGS. 6 and 7 show an alternative arrangement to that of FIG. 5. The same -V- shaped notches are used but instead of the guide 37 (FIG. 5) a guide element 41 is used. This is extruded from an aluminium alloy and is threaded through the hole 42 in the rear face 7 and comprises an upper channelled part 43 having a front wall **43*a* and a rear wall 43*b* to closely embrace the rear wall 7 at the top of the hole 42 and downwardly depending parts 44, 45 and 46. The parts 44 and 45 extend inwardly of the hole 42 and the part 46 extends outwardly thereof. The parts 44 and 46 are approximately at right angles to one another and the front wall 43*a* may be tack welded to the rear face 7 to hold the guide element in place. As the post buckles to close the faces of the notches 16 and 17 together the lower edge 47 of the hole 42 in the rear face 7 engages between the parts 44 and 46 so if there is a tendency for the post to twist these parts act as guides to reduce this tendency. It will be understood that when the edge 47 reaches the juncture 48 between the parts 44 and 46 the guide element 41 will itself crumple slightly until the upper end of the guide 41** constitutes an intermediate member jammed between the faces of the notch.

Figure 8:
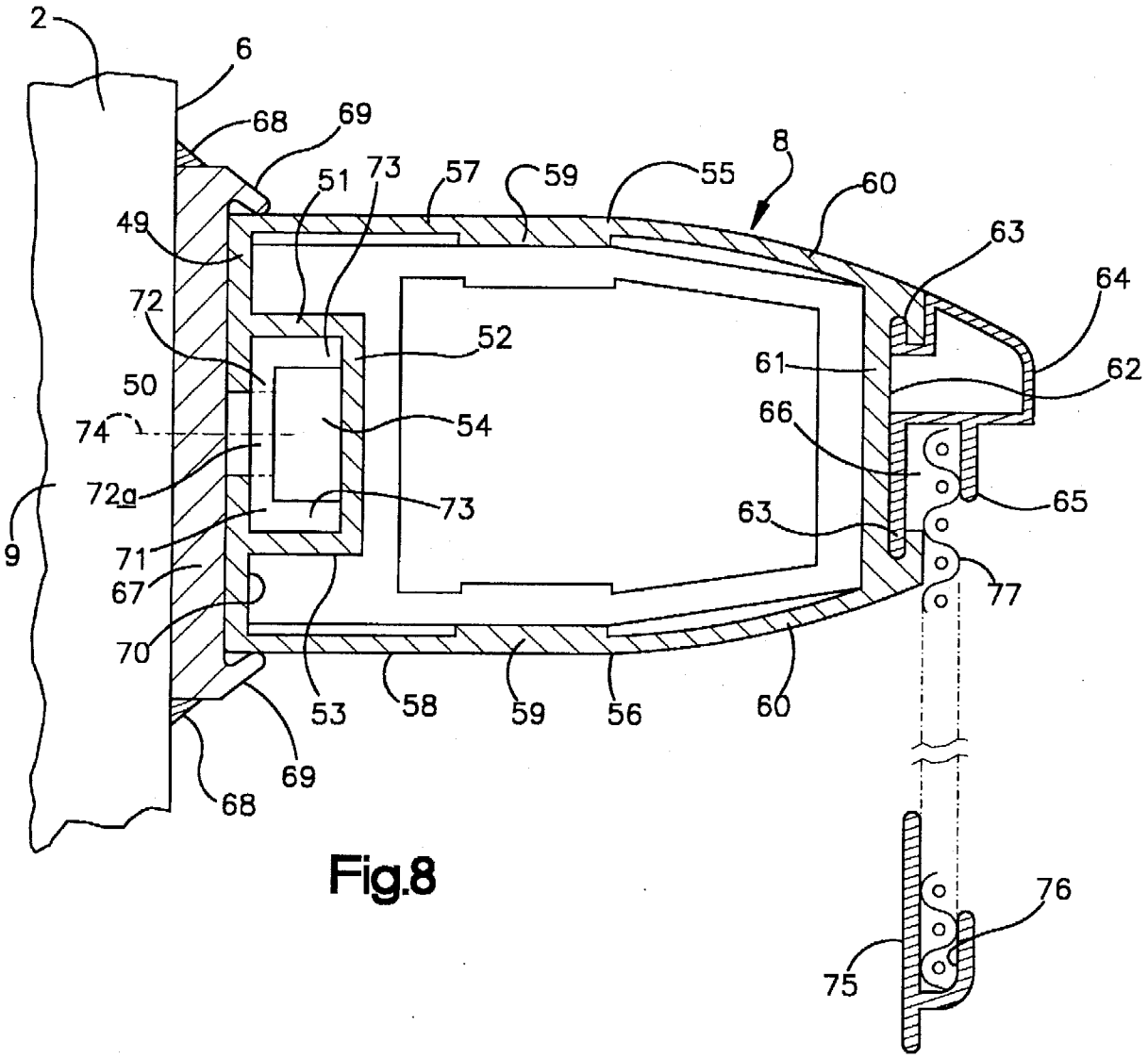
FIG. 8 is a cross-sectional view of a rail attached to a post with some parts not cross-hatched for clarity and including an infill mounting.

FIG. 8 shows a rail 8 fixed to a post 2. The rail comprises a hollow extrusion having a flat base 49 formed with a longitudinal re-entrant slot 50 bounded by walls 51, 52 and 53 defining a rectangular space 54. Upper and lower walls 55 and 56 of the rail extend at right angles outwardly of the base 49 at 57 and 58. These flat portions terminate in inward boxes 59. Thereafter the walls 55 and 56 taper at 60 to a front wall 61 parallel. With the base 49. The outer surface 62 of the front wall 61 is formed with upper and lower slots 63 to receive as a clip fit a nosing piece 64 having a downwardly depending wall 65 defining a slot 66.

A spacer 67 is welded at 68 to the front face 6 of the post 2. This spacer extends beyond both side faces 9 and 10 of the post and although shown as a flat plate in FIG. 8 it could be of -U- section to locate the rail 8 further from the front face 6. At its upper and lower edges the spacer has outwardly extending lips 69 which extend across the upper and lower walls 55 and 56 of the rail 8 with the base 49 of the rail engaging the front face 70 of the spacer 67. As shown in FIG. 8 the lips closely embrace the parts 57 and 58 of the walls 55 and 56. However these lips could be spaced further apart to allow greater ease of assembly and to permit the rails 8 to be angled relative to the posts 2 if the ground is not level.

An elongated -U- shaped member 71 is located as a good sliding fit in the space 54 with its base 72 in contact with the inner surface of the base 49 and its arms 73 lying along the walls 51 and 53 and extending to the wall 52, The base 72 is formed with a slot **72*a*. The member 71 is of the same length or longer than the spacer 67**.

Two bolts (not shown) have their heads closely located in the space 54 between the arms 73 of the washer 71. These bolts are located beyond each side wall 9 and 10 of the posts to engage through holes (not shown) in the spacer 67 on centre lines such as 74. Nuts can readily be tightened on the bolts behind the spacer and on each side of the posts.

This construction provides a fastening which is easy to accomplish on site and is readily renewable. In particular since the base 49 is firmly clamped against the front face 70 of the spacer 67 by the arrangement of the closely fitting member 71 around the bolt heads any tendency upon impact load of the bolts to tear way the base 49 at the region of slot 50 is reduced. The overall strength of this rail fixing is further enhanced by the spacing of the bolts further apart than the width of the posts. This feature together with the provision of the lips 69 also reduces any tendency for the rails to "windmill".

Usually only the uppermost rail of a crash barrier 1 is provided with the continuous nosing 64. The lowermost rail is provided with spaced apart clips 75 disposed by sliding between the slots 63 of that lowermost rail. The clips 75 have an upward facing slot 76 so that a wire mesh (or other sheet) infill 77 may be located between the slots 76 and 66. Such infill sheets may readily be replaced after damage without disturbing the rail mounting. It will be understood that a nosing need not be provided for any intermediate rail.

Figure 9:
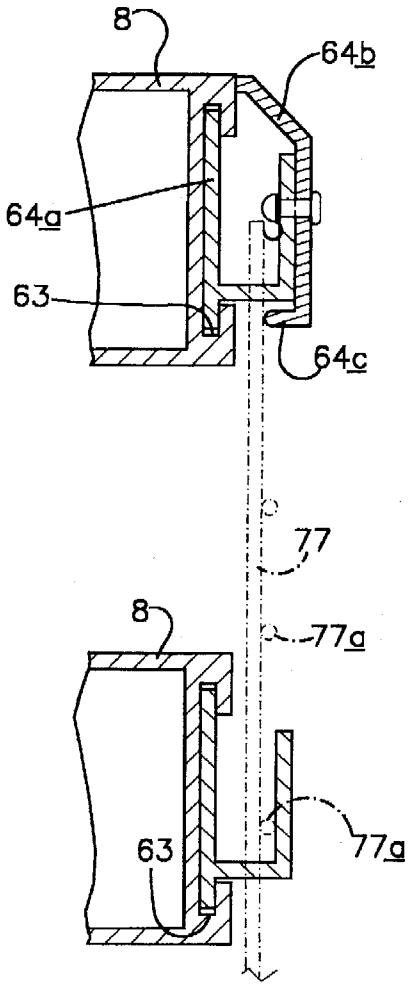
FIG. 9 is a detail to an enlarged scale showing another infill arrangement.

FIG. 9 shows a detail to a larger scale of how infill mesh may be secured to the rails. Here simple -U-shaped clips **64*a* slide into the slots 63 on each rail. The infill sheet 77 is of coarse rectangular mesh and horizontal components 77*a* are hung on to the clips 64*a* of each rail. A continuous trim strip 64*b* is rivetted to the uppermost clips and has an arm 64*c* to hold the mesh against the top rail 8**.

Figure 13:
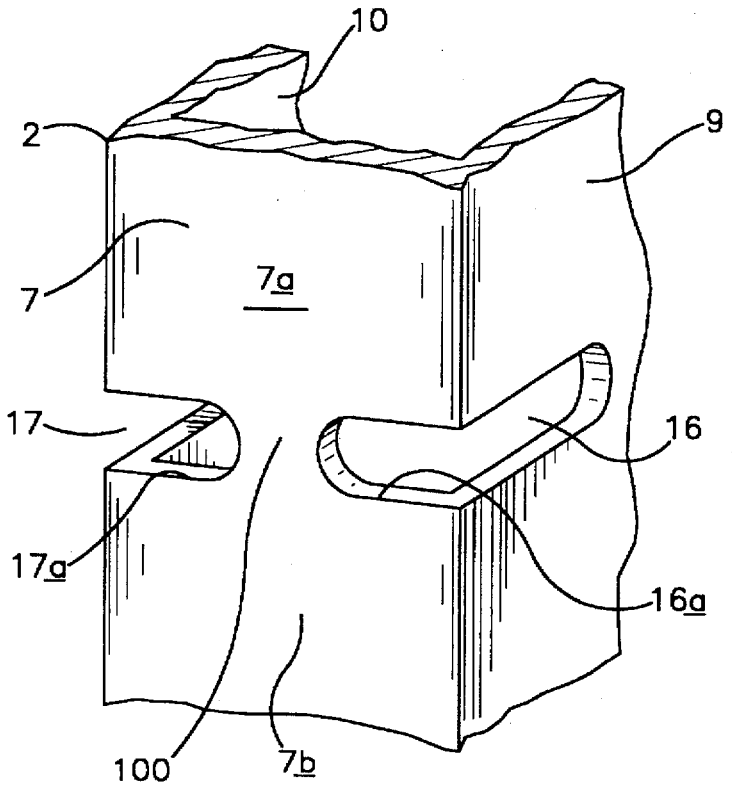
FIG. 13 is a view similar to FIG. 2 showing a modified notch arrangement and FIGS. 14 and 15 are respectively a perspective and sectional view of an alternative base mounting for the post.

In FIG. 13 a further modified post 2 is formed with notches 16 and 17 similar to the subsidiary notches in FIG. 2 but extending into the rear face 7 of the post at **16*a* and 17*a*. The parts 16*a* and 17*a* are spaced apart to leave a web 100 constituting part of the wall 7 and effectively separating an upper part 7*a* from a lower part 7*a* thereof. It will be noted that the closed ends of the notches 16, 16*a* and 17, 17*a* are smoothly rounded and of semi-circular shape. The web 100 is symmetrical of the width of the wall 7**.

It has been found that with this construction any tendency to twist about a vertical axis upon bending of the post 2 after vehicle impact is sufficiently reduced as to ensure that the notches 16, **16*a* and 17, 17*a*** close upon one another.

The web 100 performs an important function in that the initial failure load of the post 2 as it commences to buckle and bend is governed by the material in the web failing by plastic yield; preferably without buckling. This controls point 'C' in the graph of load versus displacement (FIG. 12).

As the web continues to yield plastically, the post rotates further, held in a stable manner by the web without rotating about its vertical axis, which it may otherwise tend to do.

Figure 12:
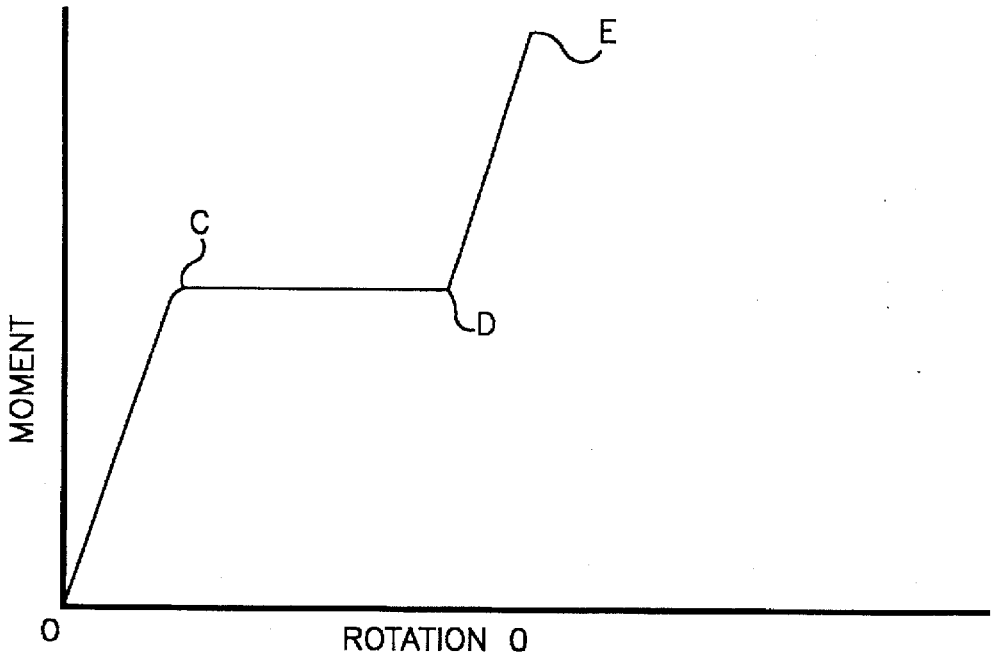
FIG. 12 is a graph showing a performance curve for a post according to the invention.

The length of the web controls the rotation between points C and D on FIG. 12 with the pure plastic yielding providing the maximum load retention of capacity during that phase, (as opposed to buckling of the web).

Eventually the web does distort, and the notches will close in a stable and secure manner, without slipping past their other halves as at point D in FIG. 12 when the stiffness of the assembly increases and load capacity increases until the base weld fails, usually by a combination of load and strain (or distortion).

It Will thus be understood that

1. The cross section and height of the web governs the plastic collapse load.

2. The proportions of the web prevent buckling thereof before plastic collapse.
3. The web contributes to stability, without which there is a significant risk of the post rotating torsionally and the upper part of the notch then not nesting securely on the bottom part as it closes, so it cannot achieve its increased load capacity between D and E on FIG. 12.
4. The depth of the side notches 16, 16*a* and 17, 17*a* contribute towards determining the position of the point D in FIG. 12.
5. The shape of the sides of the web 100 (the ends of the notches 16*a* and 17*a*) is important in contributing to the way in which the web progressively collapses plastically and also contributes to the provision of maximum load capacity between parts C and D of FIG. 12.

It will also be understood that more than one web 100 could be provided. Also, since the tendency of the post to twist under impact will always be in the same direction lit may be advantageous to have the web located asymmetrically of the wall 7. Alternatively the web 100 could comprise the whole width of the wall 7 with the notches 16 and 17 being formed wholly in the side walls.

Referring now to FIG. 12 this is a graph of turning moment plotted against rotation of a post under impact load. The part O-C represents elastic deformation of the post and at the point C the notch in the rear face 7 of the post causes buckling of the post to start in the region of the notch. The part C-D represents buckling deformation and the notch closes at the point D. Thereafter D-E represents further deformation with increased stiffness and at point E it is assumed that there is weld failure between the post and its base. It will be understood that the area beneath the curve represents energy absorbed. If a series of notches is provided, the graph would have a number of smaller steps such as C-D. As shown in FIG. 12 the line C-D is horizontal. It is desirable that it should not slope down from C to D but it could advantageously slope up.

Figure 10:
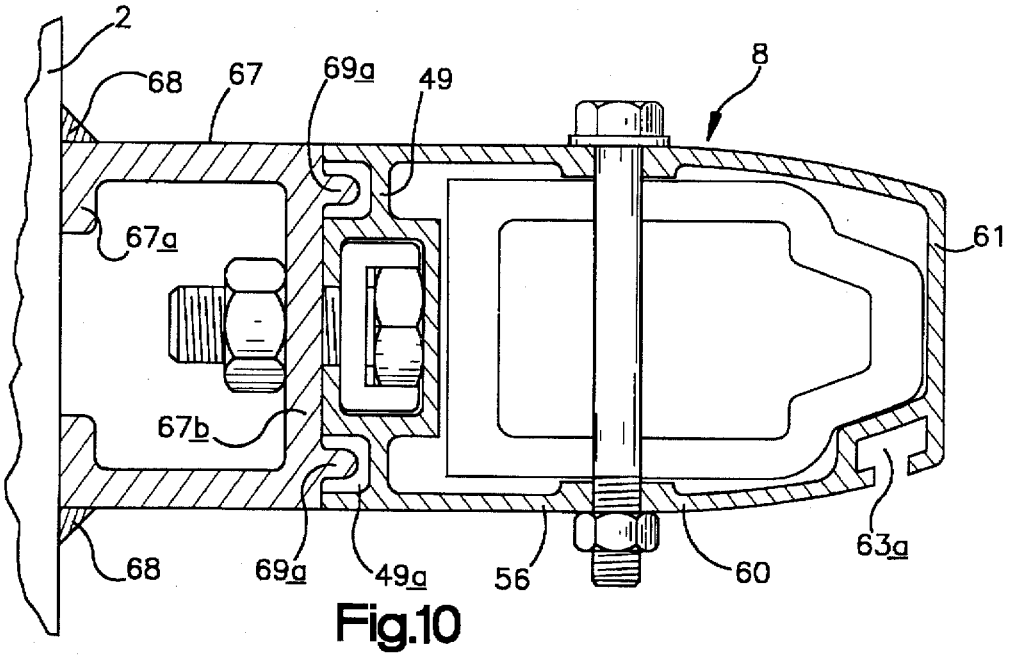
FIG. 10 is a view similar to FIG. 8 showing a modified rail and spacer.

FIG. 10 is a view similar to FIG. 8 of another arrangement of rail 8 fixed to the post 2. Here the spacer 67 is of channel section with its open face 67*a* welded at 68 to the post 2. The base 67*a* of the spacer is formed with two ribs 69*a* which extend with considerable clearance into slots 49*a* formed in the base 49 of the rail 8. This arrangement is in substitution for the lips 69 of FIG. 8. The looseness of the coupling between the ribs 69*a* and the slots 49*a* permit ease of on-site erection particularly where the barrier is located on an incline. It will be appreciated that the spacer 67 could be a flat plate as in FIG. 8.

Also in FIG. 10 the front wall 61 is not formed with slots 63 as in FIG. 8 but the rail 8 is provided with a single re-entrant slot 63*a* in the tapered part 60 of the wall 56. This removes the slot to a position on the rail of less stress and can be used to accommodate brackets (not shown) for supporting wire mesh or other sheet material.

Figure 11:
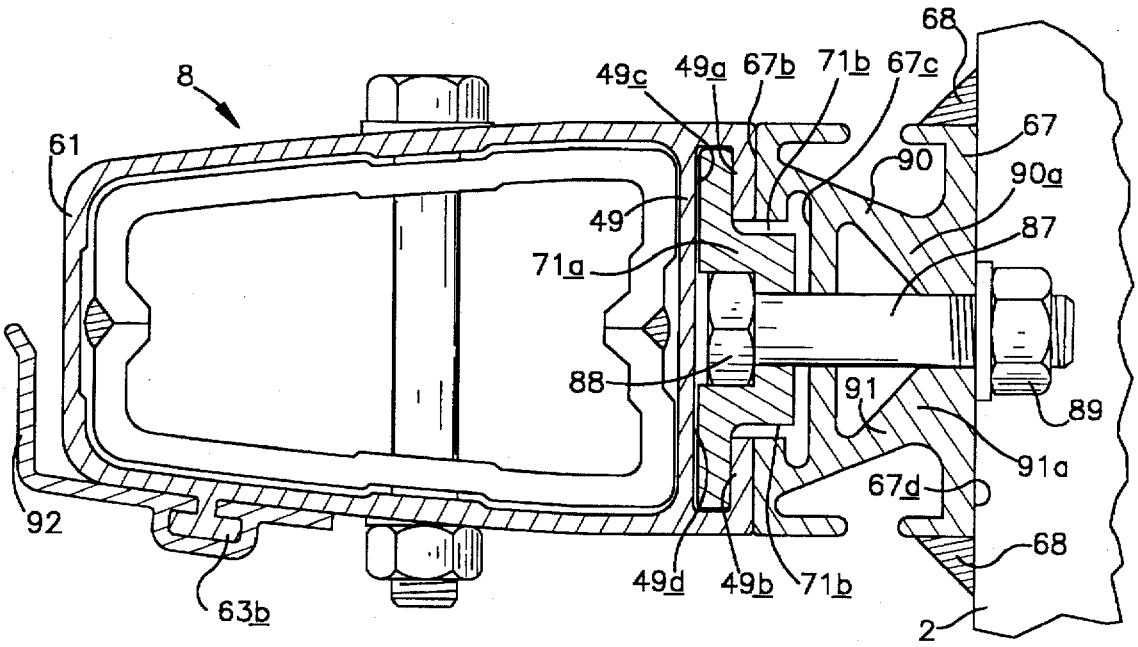
FIG. 11 shows another arrangement of rail and spacer.

FIG. 11 shows a preferred arrangement in which the base 49 is extended by parts 49*a* and 49*a* to provide longitudinal slots 49*c* and 49*d* to receive a "top-hat" washer 71*a* having shoulders 71*b* extending with substantial clearance between the parts 49*a* and 49*b*. A spacer 67 has an inner face 67*b* to abut the parts 49*a* and 49*b* and a central recess 67*c* into which the shoulders 71*b* also extend with substantial clearance. An opposed face 67*d* of the spacer is welded at 68 to the post 2. A number of fixing bolts such as 87 have their heads 88 firmly restrained against rotation in the top hat washer 71*a* and pass through apertures in the spacer 67 to receive nuts such as 89 beyond the side walls of the post 2.

It will be noted that the core of the spacer 67 is of triangular section comprising the inner face 67*b* and the walls 90 and 91. In particular the thickening of the walls 90 and 91 at 90*a* and 91*a* adjacent the opposed face 67*c* contributes to the overall stiffness of the spacer. The clearance around the shoulders 71*b* provides the desired flexibility of assembly.

It will be understood that other spacer shapes (not shown) could be used including -C- shapes and rectangular section tubes.

Instead of a re-entrant slot as at 63*a* in FIG. 10 the construction of FIG. 11 has an outwardly projecting -T-piece 63*b* over which clips such as 92 are slid from the rail end. The provision of the -T- piece projecting outwardly from the rail at a location away from its front wall 61 balances the potential stresses in the material of the rail.

The clips 92 may be on an intermediate rail to support mesh (not shown) intermediate its height. The upper end of the mesh could be riveted to the upper rail and the lower end of the mesh could be carried in clips (not shown) similar to the clips 92 and carried by brackets at the base of each post.

Figure 14:
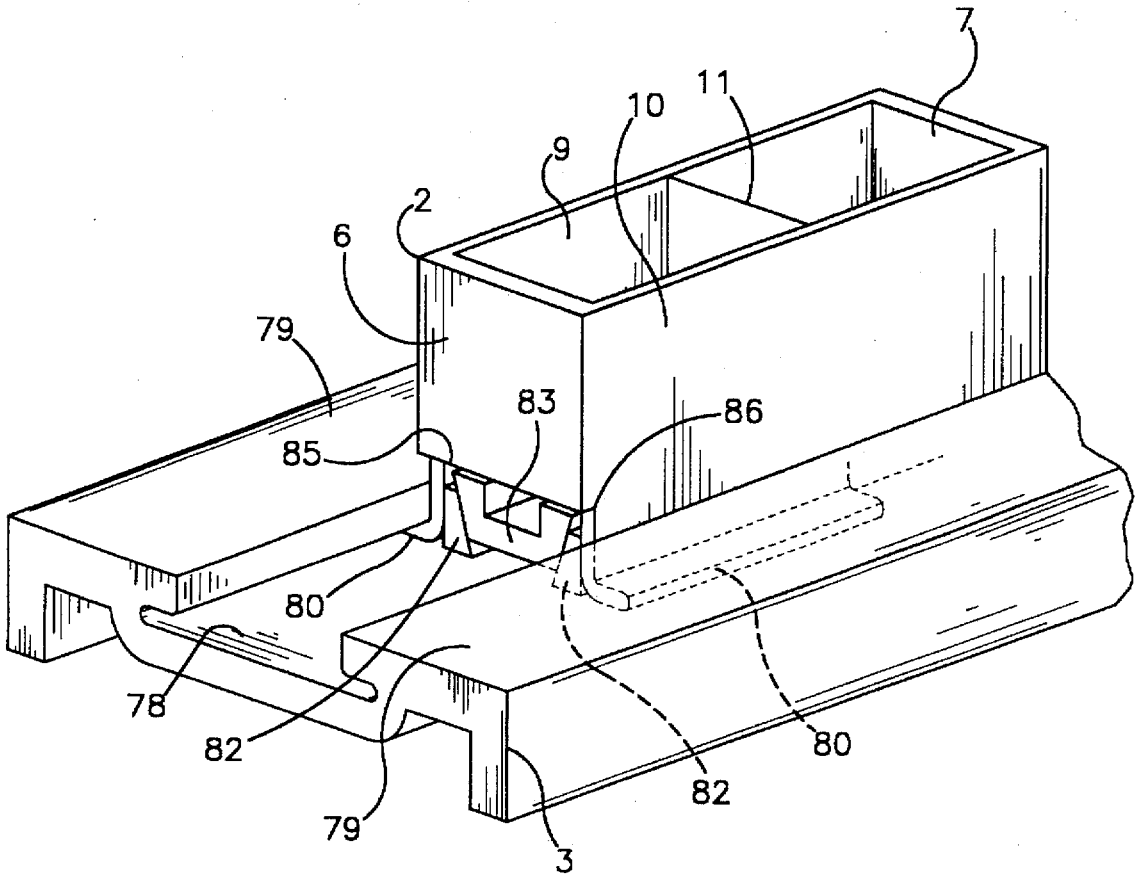
Figure 15:
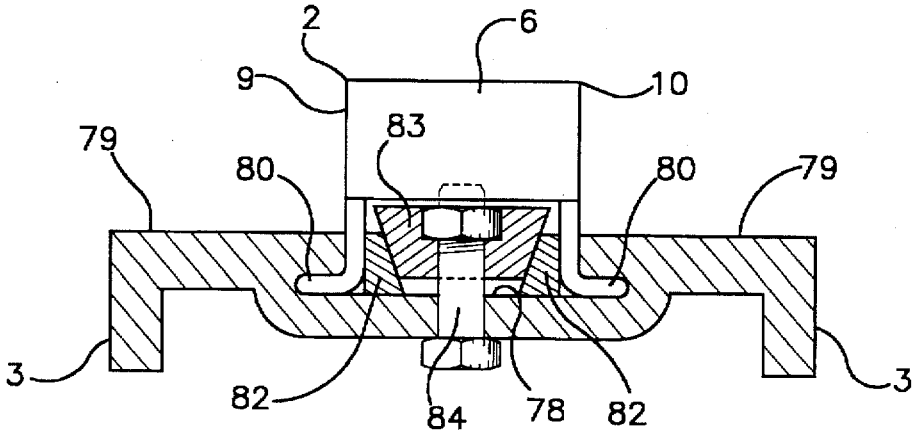

FIGS. 14 and 15 show a mechanical fixing between a post 2 and base plate 3. In this case the base plate is formed with a slotted formation 78 in its upper face 79 to receive outwardly turned lips 80 of the side walls 9 and 10 which extend only as far as the web 11. The lips 80 are forced into undercut portions 81 of the formation 78 by angled bars 82 engaged by a wedge 83 bolted at 84 through the base 3. It will be seen from FIG. 9 that the lower part of the front face 6 is cut away to provide a lip 85 with a deliberately sharp angle 86. In practice when the post finally fails under impact load the side walls 9 and 10 tear from the position 86.

It will be understood that the notched rear face 7 serves two functions. Firstly this feature enables more accurate and consistent calculation of when impact load failure occurs. Secondly when failure commences, initial buckling of the post occurs in the region of the notch and well away from the front face and particularly the connection between the post and its base plate near the front face. These features enable a crash barrier to be designed giving maximum energy absorption consistent with the maximum desirable rotation of a post under impact before the post fails. The extent of rotation is important since it is not satisfactory to have posts which fail only after very large rotation angles since a crash barrier may not properly capture the kind of vehicle to which its design is targeted.

Reverting to FIG. 12 the curve for a post without the notch of the present invention would omit the line C-D and the line D-E would be at a variety of different angles depending upon the degree of post rotation before ultimate failure occurs.

In the curve of FIG. 12 the length of the line C-D can be varied to provide the maximum acceptable deformation (and therefore the maximum energy absorption) consistent with an acceptable angle of rotation of the post before the latter ultimately fails.

As described in this specification it has been assumed that upon deformation initiated at the notched rear face of the post, the surfaces of the notches close together or against a member interposed between them. Particularly when an aluminium alloy post and base plate are used then, depending upon the particular alloy, the heat treatment to which it has been subjected and the size of the post, it may be that ultimate failure of the post occurs at or adjacent the front wall or at or adjacent the fixing between the post and the base plate before the or each notch is fully closed.

It will be understood that the present invention provides a significant advance in the design of crash barrier posts, enabling designers to provide calculated response to particular impact loads which can be accurately repeated from post to post. This advance is primarily the result of the notched rear face of the post but important contributions are added by the design of the post/base fixing and the method of securing the rails to the posts. The latter is also important in reducing "windmilling" upon impact.

In addition the present invention provides a crash barrier which is easy to install and repair. Furthermore existing barriers may readily be modified by the roadside to incorporate features of the present invention.

We claim:

1. A crash barrier (1) comprising at least one post (2) having a lower end (12) secured to a base (3), a front face (6) to which at least one rail (8) is secured, a rear face (7) and two side faces (9 and 10), characterized in that the rear face has a length and is formed at a position intermediate said length with at least one horizontally extending notch (13, 16, 17) having an upper surface (18) and a lower surface (19) so that, when the lower end is restrained, an impact load transmitted to the front face causes the post to distort in a region including the notch so that the surfaces close towards one another prior to any fracture at or adjacent at least one of the front face of the post and its restrained lower end.

2. A crash barrier according to claim 1 in which the distortion continues until the upper and lower surfaces close together.

3. A crash barrier according to claim 2 in which the impact load required to distort the at least one post after the surfaces have closed together is not less than that required to commence closure of the surfaces.

4. A crash barrier according to claim 1 further comprising an intermediate member between said upper surface and said lower surface, wherein the distortion continues until the surfaces close on to said intermediate member (41).

5. A crash barrier according to claim 1 wherein said at least one post is a hollow extrusion from an aluminum alloy and is generally rectangular in cross-section, having a web (11) extending across the at least one post between said two side faces at a position spaced from the front and rear faces.

6. A crash barrier according to claim 1 in which said rear face has an upper end which is tapered upwardly towards the front face.

7. A crash barrier according to claim 1 in which said at least one notch is -V- shaped.

8. A crash barrier according to claim 1 in which said at least one notch is parallel sided and includes a flat base incorporating subsidiary notches.

9. A crash barrier according to claim 1 in which means are provided to encourage the at least one post to distort evenly across its width after being subject to an impact load.

10. A crash barrier according to claim 9 in which a -U- shaped guide (32) embraces the rear face and extends along the side faces of the at least one post in the region of the at least one notch.

11. A crash barrier according to claim 9 in which a guide (41) is disposed in contact with said upper surface and has parts extending both inside and outside the rear face in spaced relationship to said lower surface.

12. A crash barrier according to claim 11 in which said at least one notch includes at least two notches separated by at least one web (100) joining said upper surface and said lower surface.

13. A crash barrier according to claim 12 in which the at least one web deforms plastically prior to said upper and lower surfaces of the at least two notches closing together.

14. A crash barrier according to claim 1 wherein said at least one post includes a series of posts according to claim 1 arranged generally vertically in spaced apart relation and wherein said base includes a base plate mounted on a plinth (4) firmly anchored in the ground, each post in said series of posts being joined by at least one rail extending transversely across the front faces of the posts.

15. A crash barrier according to claim 14 in which said at least one rail is secured to spacers (67) welded to the front face of each post.

16. A crash barrier according to claim 15 in which formations (69, 69*a*) engaging between said at least one rail and the spacers are provided to prevent rotation of said at least one rail relative to the posts.

17. A crash barrier according to claim 15 in which the spacers extend beyond each side face of the posts and the at least one rail is bolted only to the spacers.

18. A crash barrier according to claim 15 in which each of said at least one rail has a rear face, a re-entrant slot (50) formed in its rear face, a plurality of bolts having heads received in said re-entrant slot with the intermediary of an elongated member (71) disposed beneath the bolt heads and bearing against an inner surface of the rear face of the rail, the rear face of the rail having an outer surface in close contact with the spacer.

19. A crash barrier according to claim 18 in which the member is of "top hat" cross sectional shape (71*a*).

20. A crash barrier according to claim 18 in which the member (71) is -U- shaped having a base wall and side walls which closely embrace the bolt heads, the member being approximately the same length as the spacer.

21. A crash barrier according to claim 14 in which said at least one rail includes an uppermost rail and a lower rail which are formed with front faces having longitudinal upper and lower re-entrant slots, said slots receiving nose pieces (64) carrying a screen material, and said screen material having an upper edge, a lower edge, and horizontal components.

22. A crash barrier according to claim 21 in which the nose piece in the uppermost rail is a clip fit therein and extends continuously therealong having a downwardly opening slot which receives the upper edge of the screen material.

23. A crash barrier according to claim 22 in which a multiplicity of bracket-like nose pieces (75) are disposed in said lower rail to support the lower edge of the screen material.

24. A crash barrier according to claim 21 in which the nose piece on each rail is slidable in one of said slots and comprises a hook (92) engaging with said horizontal components of the screen material.

25. A crash barrier according to claim 24 in which a continuous trim is secured to the hook of the uppermost rail and has a part to hold the upper end of the screen material against the rail.

26. A cash barrier according to claim 14 in which the at least one rail is formed with at least one outwardly projecting member (63*b*) to receive clips for carrying a screen.

27. A crash barrier according to claim 14 in which the base includes a base plate of an aluminum alloy extrusion.

28. A crash barrier according to claim 27 in which the base plate has a flat lower face (21), side flanges (3) and a central platform (24), said side flanges having upper faces and said platform being raised above upper faces of the flanges, said platform having side edges which are bounded by upwardly extending longitudinal ribs (26), and wherein shoulders (27) extend outwardly of the ribs intermediate the levels of the platform and the upper faces.

* * * * *